United States Patent [19]

Spitzke

[11] 4,363,312

[45] Dec. 14, 1982

[54] BOW MOUNTED QUIVER

[75] Inventor: Arthur Spitzke, Troy, Mich.

[73] Assignee: Schmelzer Corporation, Flint, Mich.

[21] Appl. No.: 973,229

[22] Filed: Dec. 26, 1978

[51] Int. Cl.[3] ..... F41B 5/06

[52] U.S. Cl. ..... 124/45; 124/88; 124/24 R; 224/916; 273/DIG. 2; 273/DIG. 12

[58] Field of Search ..... 124/23 R, 23 A, 24 R, 124/24 A, 41 A, 45, 48, 51 R, 88; 224/916; 24/73 R; D22/13; 403/325, 330, 326, 321

[56] References Cited

U.S. PATENT DOCUMENTS

| | | | |
|---|---|---|---|
| 3,017,874 | 1/1962 | Gubash | 224/916 X |
| 3,085,222 | 4/1963 | Watts | 24/73 R |
| 3,116,730 | 1/1964 | Tingley | 124/48 X |
| 3,209,740 | 10/1965 | Hauch | 124/24 A |
| 3,286,961 | 11/1966 | Mandolare | 124/24 A |
| 3,490,662 | 1/1970 | Ramsey | 124/24 A |
| 3,552,708 | 1/1971 | Hillstrom | 24/73 R X |
| 3,777,734 | 12/1973 | Rose | 224/916 X |
| 3,840,944 | 10/1974 | Gresley . | |

*Primary Examiner*—Richard J. Apley
*Assistant Examiner*—William R. Browne
*Attorney, Agent, or Firm*—Fisher, Gerhardt, Crampton & Groh

[57] ABSTRACT

An archery quiver for detachable connection to an archery bow having a telescoping prong and socket mounting arrangement in which all of the components are made of plastic and in which the prong and socket are locked relative to each other by a deflectable plastic latch and latch release mechanism. The latch is deflected upon relative movement of the prong and socket to permit telescoping after which the latch returns to its original position to prevent separation. A separate release mechanism is used to deflect the latch to permit detachment of the quiver from a bow.

5 Claims, 7 Drawing Figures

BOW MOUNTED QUIVER

This invention relates to archery and more particularly to quivers for detachable connection to an archery bow.

A large variety of bow mounted quivers have been devised, each offering the advantages of having arrows arranged for convenient and rapid use but usually having some disadvantages. Some bow mounted quivers affect movement of the bow limbs or are semi-permanently attached and require tools for removal. Also, some quivers obstruct the use of other accessories used on bows such as sights or the like, and when detachable are often difficult to attach and detach, requiring the use of both hands.

It is an object of this invention to provide an improved quiver for connection to an archery bow which is arranged for rapid attachment and detachment and at the same time holds the quiver securely locked in position during use of the bow without obstructing flexing of the bow limbs.

Another object of the invention is to provide a quiver which is supported on the bow by a mounting arrangement of simple construction which locks the quiver in position on the bow but employs a minimum number of parts and avoids the uses of pivot pins and springs and the like.

A further object of the invention is to provide an archery quiver for detachable connection to a bow in which the components are all of plastic and are incorporated in a minimum number of parts resulting in a quiver which is easily manufactured and assembled and which is durable, light, easily and quickly attached and detached from a bow and is highly efficient in use.

The objects of this invention are accomplished by a construction in which an archery quiver is provided with a mounting member cooperating with another mounting member fastened to the handle of a bow opposite the arrow rest. The mounting members incorporate a coacting socket and prong incorporating a latch element which is deflectable out of its normal position to permit entry of the prong into the socket and when seated within the socket, the latch element moves to a locking position. A latch release arrangement is engageable with the latch element to move it to a retracted position permitting removal of the prong from the socket and therefore detachment of the quiver from the bow. Deflection of the latch element is accomplished automatically upon attachment of the quiver to the bow and may be released from its latched position simply with one hand for removal of the quiver from the bow.

These and other objects of the invention are accomplished by the embodiments disclosed in the following description and illustrated in the drawings in which.

Figure 1:
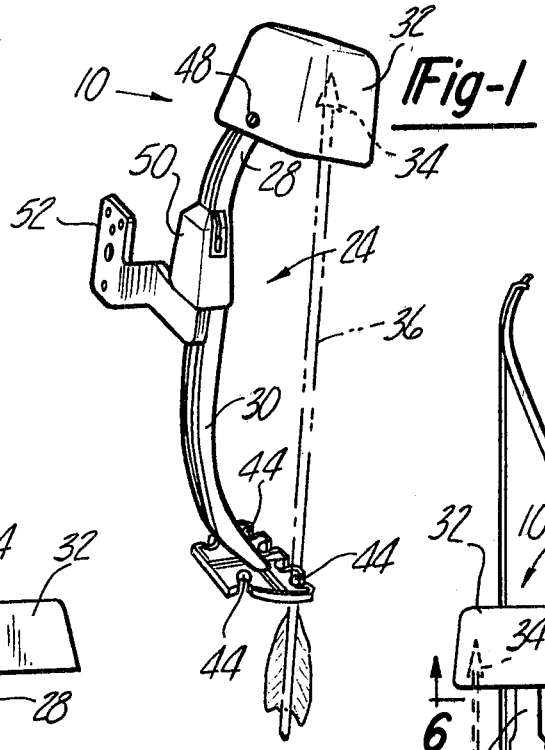
FIG. 1 is a perspective view of an archery quiver assembly the invention shown removed from the bow but from a vantage point as it would appear from the rear of the bow.

An archery quiver embodying the invention is generally designated at 10 and is adapted to be mounted on an archery bow 12 having upper and lower flexible limbs 14 and 16, respectively, extending in opposite directions from a rigid handle area 18 having a hand grip 20 and an arrow rest 22 at one side of the hand grip 20.

Figure 3:
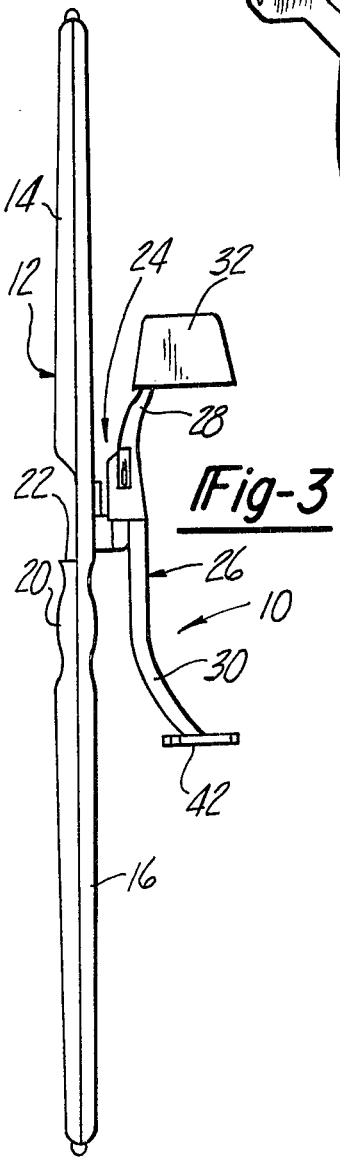
FIG. 3 is a rear view of the bow seen in FIG. 2.
Figure 2:
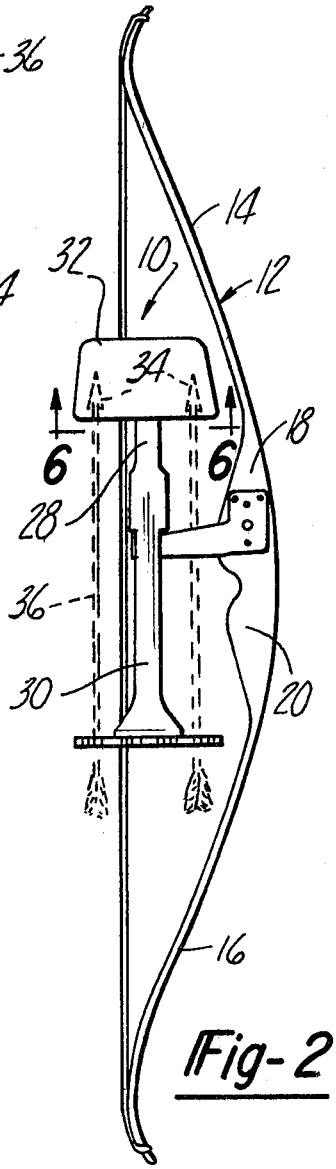
FIG. 2 is a side elevation of a bow with the archery quiver mounted thereon.
Figure 6:
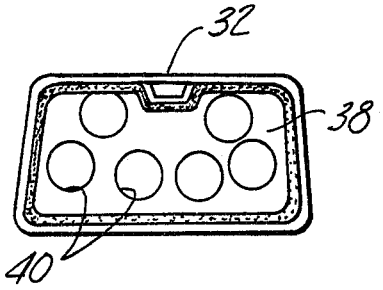
FIG. 6 is a view of a portion of the quiver taken on line 6—6 in FIG. 2.

The quiver 10 is adapted to hold a plurality of arrows in parallel spaced relationship to each other and when the quiver is mounted on the bow 12, the quiver 10 and the arrows are disposed at one side of the bow opposite to the arrow rest 22 as seen in FIG. 3. The archery quiver 10 is held on the bow 12 by an attaching arrangement indicated generally at 24. The quiver itself is made entirely of plastic and includes a frame 26 made up of an upper arm 28 and a lower arm 30 extending in opposite directions from the attaching arrangement 24. The upper extremity of the upper arm 28 supports a housing 32 adapted to receive and contain the heads 34 of the arrows 36. As best seen in FIG. 6, the cup shaped housing 32 contains a pad 38 having a plurality of spaced recesses 40 for receiving the arrow heads 34 and maintaining them in spaced apart relationship within the housing 32.

As seen in FIG. 1, the lower end of lower arm 30 is provided with a rack 42 having a plurality of notches 44 arranged in spaced apart relationship generally conforming to the number and arrangement of the recesses 40 in the housing 32. The rack 42 is preferably made of an elastomeric material such as a relatively softer plastic than plastic making up the frame 26. The resilient rack 42 is adapted to resiliently grip the shafts of the arrows 36 and to maintain them in spaced apart parallel relationship to each other so that neither the heads 34 nor the feathers of the fletching 46 come in contact with each other.

The entire quiver 10 including the attaching arrangement 24, the frame 26, the housing 32 and the rack 42 are made of plastic material. Preferably the housing 32, frame 26 and attaching arrangement 24 are made of a relatively rigid plastic such as acrylonitrile butadyne styrene or a high density polyethylene, whereas the pad 38 disposed within the housing 32 and contacting the arrow heads and the rack 42 are made of a relatively softer resilient plastic such as polyurethane. The cup shaped housing 32 is preferably molded as a separate part and is fastened to the upper arm 28 by means of a screw 48. The rack 42 also is made as a separate part and can be fastened to the lower end of arm 30 by means of screw fasteners, not shown.

The attaching arrangement 24 includes a first mounting member 50 forming part of the quiver 10 and a second mounting member 52 which is attached to the bow 12. As seen in FIG. 6, the mounting member 52 includes a mounting pad 54 adapted to fit against one side of the handle area 18 of the bow 12 opposite to the arrow rest 22 and to be fastened to the handle area 18 by means of screw fasteners passing through the openings 56 or 57 and into the handle area 18. A prong 58 is connected to the pad 54 by means of a bracket 60 which holds the prong offset rearwardly and to one side of the pad 54.

Figure 4:
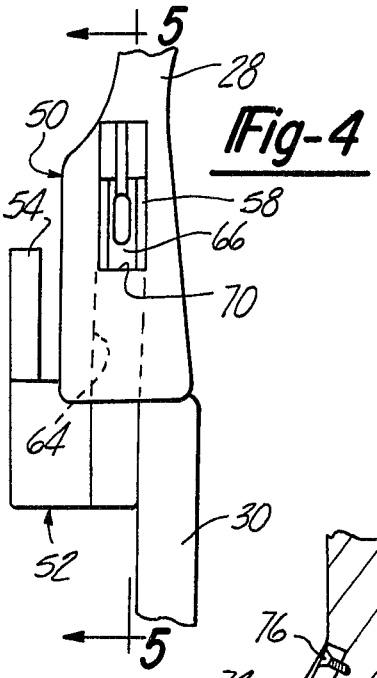
FIG. 4 is an enlarged fragmentary view of a portion of the attaching means for holding the quiver on the bow.

The prong 58 is adapted to be received in a socket member 62 of the mounting member 50 having a prong receiving cavity 64. The socket member 62 is molded integrally with the upper and lower arms 28 and 30 forming the frame of the archery quiver 10. As viewed in FIG. 4 the cavity 64 is formed to one side of the lower arm 30 and as viewed in FIG. 3 opens downwardly in the direction of the lower bow limb 16.

Figure 5:
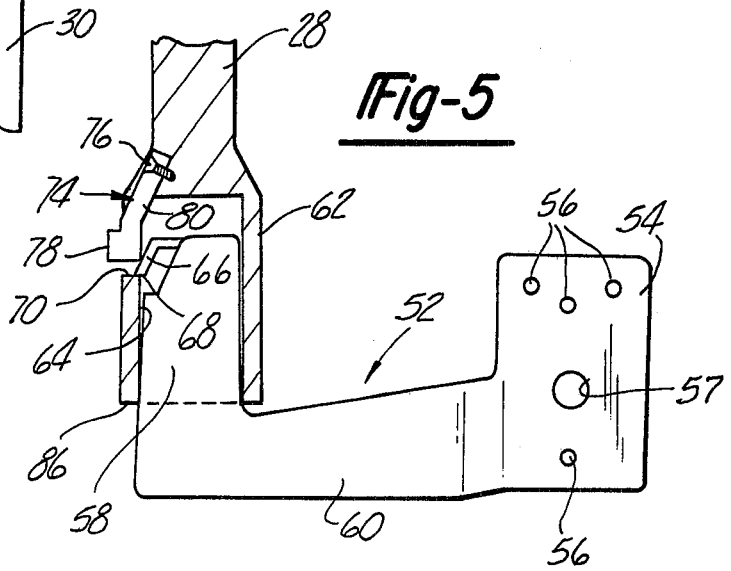
FIG. 5 is a cross sectional view taken on line 5—5 in FIG. 4.

Referring to FIG. 5, the prong 58 of the mounting member 50 is provided with a latch element 66 which is formed integrally with the prong and is of a configuration permitting deflection of the end 68 relative to the remainder of the prong 58. In the attached condition of the quiver 10 on the bow 12, the end 68 of the latch element 66 engages edge or latch receiving portion 70 formed at the lower end of an opening 72 communicating with the upper end of the cavity 64 in socket member 62. Such engagement acts to maintain the prong 58 tightly in the socket member 62 and prevents removal until the latch element 66 is deflected out of the position illustrated in FIG. 5.

Associated with the socket member 62 is a latch release member 74 which may be formed integrally with the socket member 62 or if desired may be formed separately of plastic material and attached adjacent to the socket member 62 by means of a screw indicated at 76 in FIG. 5. In either event the latch release member 74 has a push button 78 at one end of a relatively flexible arm portion 80. Depression of the button 78 engages it with the latch element 66 so that the latch end 68 is deflected out of engagement with the edge 70. Deflection of the latch element 66 permits the prong 58 to be retracted from the socket member 62 so that the quiver 10 is separate from the bow 12.

Figure 7:
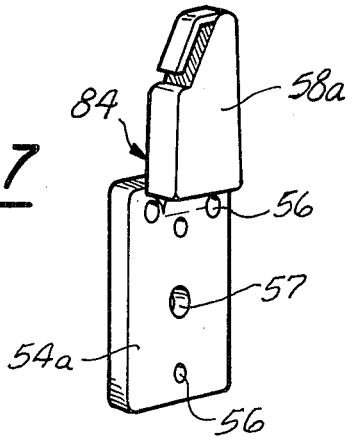
FIG. 7 shows a modified form of one of the components used in attaching the quiver to the bow.

Referring now to FIG. 7, a modified form of mounting member 84 is illustrated which is similar to the mounting member 52 in that **54*a* similar to pad 54 and a prong 58*a*. In the mounting member 84, however, the prong 58*a* is formed adjacent to the pad 54*a* and is offset upwardly and to one side of the pad 54*a*. The mounting member 84 is molded in a single piece of plastic material. The purchasers of quivers 10 can be supplied with both types of mounting members 58 and 84 so that the one of his choice can be used or if desired, one may be substituted for the other simply by removing screws in the openings 56 and 57 of the pads 54 or 54*a***.

The quiver 10 can be attached to the bow 12 by placing the prong 58 in alignment with the cavity 64 of the socket member 62. Relative movement of the quiver towards the lower limb 16 of the bow 12 will cause the latch element 66 to engage the lower edge 86 of the socket member 62 and deflect it from its normally as-molded attitude or position as illustrated in FIGS. 5 and 7 so that the prong can enter the cavity 64. When the prong 58 reaches its seated condition as seen in FIG. 5, the latch element 66 returns to its as-molded condition and the end 68 engages the edge 70. Subsequently, when it is desired to remove the quiver 10 from the bow 12, the latch release member 74 is actuated by moving the button 78 and deflecting the latch element 66 from its as-molded condition to permit removal of the prong 58 from the cavity 64 thereby removing the quiver 10 from the bow 12.

An archery quiver has been provided which is adapted for easy and rapid attachment and detachment from a bow. The quiver is molded entirely of plastic material and is made up of a minimum number of parts. The separate parts are rigidly fastened together and are made separately only for the purpose of facilitating molding. All movable parts can be formed integrally with adjacent parts thereby simplifying construction. In one embodiment of the invention the bow mounted mounting member positions the quiver rearwardly of the leading edge of the bow and to one side and in another modified form, the mounting member is mounted more closely to the bow giving an archer a choice of quiver positions relative to the bow.

The embodiments of the invention in which an exclusive property or privilege is claimed are defined as follows:

1. An archery quiver for attachment and detachment to an archery bow in which the quiver can hold a plurality of arrows having heads and shafts, said quiver comprising; spaced apart housing and rack members, said housing having a portion for arrow heads and said rack member being adapted to engage and grip arrow shafts, a first mounting member formed integrally with said quiver at a point intermediate said housing and rack members, a second mounting member being adapted to be mounted on the handle of said bow, one of said mounting members including a socket and the other of said mounting members including a complementary prong to be detachably received in said socket, a latch element formed as a unit with said prong and being deflectable relative to said prong and into engagement with a latch receiving portion associated with said socket to prevent removal of said prong from said socket, and deflectable means associated with a wall of said socket for manual movement into engagement with said latch element to deflect said latch element out of engagement with said latch receiving portion to permit removal of said prong from said socket during detachment of said quiver from the bow.

2. The combination of claim 1 wherein said latch release means is formed integrally with said socket and said socket and latch release means are made of plastic.

3. The combination of claim 1 wherein said latch element and said prong are formed integrally with each other and are made of plastic.

4. The combination of claim 1 wherein said second mounting member has a bracket connectable to said handle of said bow and a brace extending rearwardly from said bracket to support one of said mounting members, said quiver being positioned in its attached position intermediate the bow limbs and the string of the bow when the bow is strung.

5. The combination of claim 1 wherein said first socket and said prong are formed integrally with their associated mounting members and are made of plastic.

* * * * *

UNITED STATES PATENT AND TRADEMARK OFFICE

CERTIFICATE OF CORRECTION

PATENT NO. : 4,363,312

DATED : December 14, 1982

INVENTOR(S) : Arthur Spitzke

It is certified that error appears in the above—identified patent and that said Letters Patent is hereby corrected as shown below:

Column 1, line 58, "assembly" should read --embodying--.

Signed and Sealed this

*Fifth* Day of *April 1983*

[SEAL]

*Attest:*

GERALD J. MOSSINGHOFF

*Attesting Officer*

*Commissioner of Patents and Trademarks*